United States Patent [19]

Querengasser

[11] 4,123,126

[45] Oct. 31, 1978

[54] COMPACT SHELVING APPARATUS

[75] Inventor: Norman A. Querengasser, Methuen, Mass.

[73] Assignee: Andrew Wilson Company, Lawrence, Mass.

[21] Appl. No.: 821,700

[22] Filed: Aug. 4, 1977

[51] Int. Cl.[2] ..... A47B 53/00; A47B 87/00

[52] U.S. Cl. ..... 312/201; 211/1.5; 211/162; 312/198

[58] Field of Search ..... 312/198, 199, 200, 201, 312/341 R; 206/45.11; 211/1.5, 162, 186

[56] References Cited

U.S. PATENT DOCUMENTS

| | | | |
|---|---|---|---|
| 2,644,588 | 7/1953 | Brown | 312/331 |
| 2,812,069 | 11/1957 | Trammell | 211/162 |
| 2,981,584 | 4/1961 | Friend | 312/341 R |
| 3,923,354 | 12/1975 | Young | 312/199 |

FOREIGN PATENT DOCUMENTS

| | | | |
|---|---|---|---|
| 262,746 | 11/1965 | Australia | 312/201 |
| 696,130 | 10/1964 | Canada | 312/199 |
| 737,821 | 7/1966 | Canada | 211/162 |
| 1,119,518 | 6/1956 | France | 312/198 |
| 1,441,681 | 5/1966 | France | 312/199 |

*Primary Examiner*—Mervin Stein
*Assistant Examiner*—Alex Grosz
*Attorney, Agent, or Firm*—Pearson & Pearson

[57] ABSTRACT

Compact shelving consisting of a cluster of elongated, upstanding stacks of shelves juxtaposed side by side are accessible by mounting each elongated stack on an elongated carriage having rear rollers guided in elongated floor tracks coextensive in length and width with the stack and hidden thereunder. There are plastic tired wheels under the front of the carriage so that the carriage and stack can be moved, endwise on a track out of the cluster to expose the open side shelves. Front shelves increase the storage capacity. A removable crank on the front end, through twist-belt power transmission, advances and retracts each stack.

9 Claims, 9 Drawing Figures

20
24
27
27
24
23
26
25
28
27
26
29
26
21
27
23
26
22
30
24
23
28
24

41
44
46
47
54
45
43
51

26
90
88
92
87
31
89
91
32
33
39
37
34
38
71
69
72
73
74
71
30
36
35
AISLE
21

31
88
91
92
71
34
35
73
74
75
71
69
21
61
62

COMPACT SHELVING APPARATUS

BACKGROUND OF THE INVENTION

The storage capacity of the stacks of modern libraries are rapidly being exhausted for the reason that the stacks and aisles are fixed, the storage space is fixed and yet publishers continue to turn out books year after year.

Thus many libraries, and other institutions, or businesses which must store an inventory in a fixed space have turned to mobile shelving.

Exemplary of one form of such mobile, or compact, storage is U.S. Pat. No. 3,427,085 to Staller of Feb. 11, 1969 in which a cluster of juxtaposed, elongated side by side, upstanding stacks of shelves are mounted to roll on laterally extending guide tracks, by a manual sidewise push or a front end wall handle. A similar compact storage system is disclosed in U.S. Pat. No. 3,801,176 to Higbee of Apr. 2, 1974 wherein a similar cluster of open elongated baskets are mounted to move laterally on a pair of guide tracks, to segregate one of the baskets, by manual means.

In a more sophisticated form, compact shelving for libraries is taught wherein the elongated stacks are moved sidewise on sidewise, or lateral, tracks by means of the mechanical advantage of a lever on the front end as in U.S. Pat. No. 3,567,299 to Lundquist of Mar. 2, 1971. A handwheel, rotatable in a plane parallel to the front end, to turn wheels rotating in a parallel plane is taught in U.S. Pat. No. 3,944,309 to Taniwaki of Mar. 16, 1976. The stacks are connected by releasable links and moved sidewise on sidewise extending tracks by a fluid actuated piston and cylinder in U.S. Pat. No. 3,080,204 to Lindhgren of Mar. 5, 1963.

A still more sophisticated, costly and complicated form of compact shelving is disclosed in the following patents:

U.S. Pat. No. 3,168,361 to Naito of Feb. 2, 1965

U.S. Pat. No. 3,535,009 to Cain of Oct. 20, 1970

U.S. Pat. No. 3,615,122 to Naito of Oct. 26, 1971

U.S. Pat. No. 3,967,868 to Baker, Jr., of July 6, 1976 in all of which, each stack is provided with its own electric motor drive so that a single longitudinally extending aisle may be created between two adjacent stacks of the cluster to give access to open side shelves thereon.

A disadvantage of all such sidewise movable stacks, mounted on sidewise extending tracks, whether manually or power moved is that at least one stack width of track must project beyond the cluster to be tripped over, or requiring that the entire track be embedded in the floor, or that a raised floor be installed around the tracks, both expensive alternatives. Another disadvantage, is that only one longitudinally extending space for access to the stacks, is possible at a time, in conventional such installations, thus requiring others to wait until a book has been selected and the stacks again separated at a different space.

SUMMARY OF THIS INVENTION

In this invention, unlike the above prior art, the elongated stacks are clustered in side-by-side, juxtaposition, but the guide tracks run longitudinally, rather than laterally, and each stack is provided with its own set of longitudinally extending tracks, normally entirely hidden thereunder, so that there are no track projections to be tripped over. Thus a cluster of stacks, each with its own set, of a plurality of parallel sets, of tracks, can provide access to several stacks at the time by merely rolling the stacks forwardly, or endwise out into the aisle and on the floor of the building.

On an elongated carriage supporting each stack, a pair of rollers are mounted at the rear and guided in a pair of spaced parallel tracks and a pair of plastic tired wheels are mounted at the front end for rolling on the floor as the stack advances and retracts in an endwise direction from back end to front end and vice versa.

A set of open shelves is mounted on the front end of each stack to increase storage capacity by about twenty percent, these shelves being always open and accessible even when the stacks are in cluster, close-packed, configuration. Each side shelf and front shelf is formed of sheet material with an integral, upturned side flange, or front flange respectively to avoid dislodgment of books during motion of the mobile stack.

Handle means is mounted on the front end of each stack at about waist height and may be a downturned, integral flange gripable by the finger, on one of the waist high shelves. Preferably however, a crank arm is turnable in a plane parallel to the front end of each stack and is connected by a twist belt and pulley power transmission train to the axle upon which the wheels are fast, so that turning the handle in a lateral plane move the stack in a longitudinal plane in and out of the cluster.

DESCRIPTION OF PREFERRED EMBODIMENT

Figure 1:
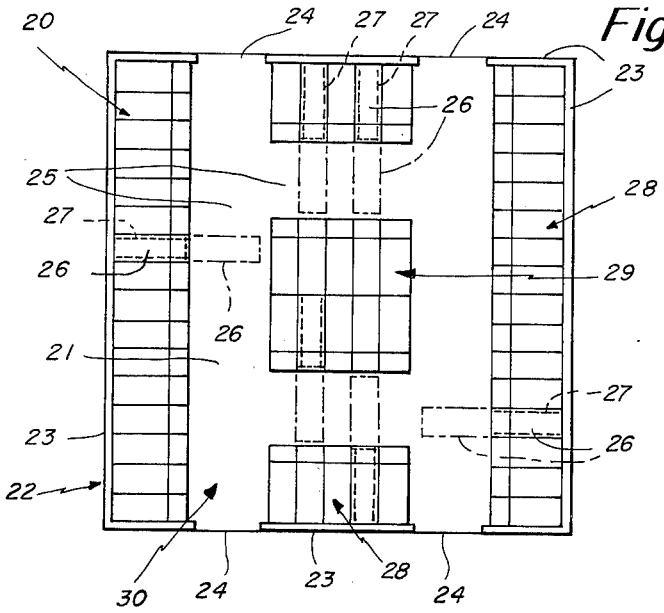
FIG. 1 is a schematic plan view of a floor plan of a typical library, showing the fixed aisles and showing in dotted lines the endwise movement of the stacks of the invention in and out of the aisles.

The compact shelving 20, of the invention is shown schematically and small scale in FIG. 1 as installed on the floor of a typical library building 22 having walls 23, doors 24, and access aisles 25.

Compact shelving 20, comprises a plurality of individual units, or modules, such as 26, each elongated as shown in FIGS. 2, 3, 4, 6, and 7 and of predetermined length and width substantially coextensive with the length and width of a single set of elongated, parallel, guide tracks 27.

In accordance with the invention the units 26 may form a cluster 28 backed up to a wall, or may form a dual back to back cluster 29 in the centre of the room 30.

As shown in the drawings each cluster 28, or 29, comprises a plurality of identical elongated, units, such as 26, each comprising an upstanding stack 31 of horizontal shelves, each stack 31, having a front end 32 and a rear end 33 of predetermined width, which extend laterally and having a pair of opposite sides 34 and 35 of predetermined length which extend longitudinally and include sets of shelves 36, 37, 38 and 39 therealong.

The stacks 31 are normally juxtaposed in side-by-side relation to form a cluster 26 or 29 of compact shelving 20 and with no guide tracks protruding from the cluster to cause tripping. As shown in dotted lines in FIG. 1, and schematically in FIG. 4, any single unit, 26, or stack 31, of shelves, may, however, be moved horizontally in an endwise direction, on its tracks out into an aisle 21 for separation to give access to books on the opposite side shelves 36, 37, 38 and 39.

Figure 9:
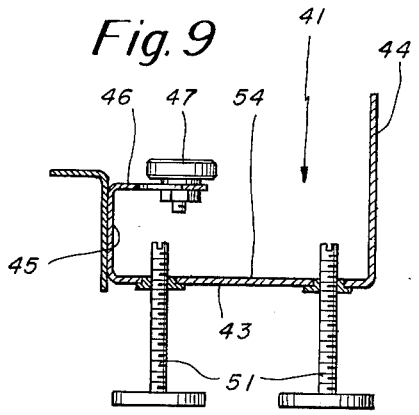
FIG. 9 is an enlarged detail view, in section, of one of the tracks.
Figure 2:
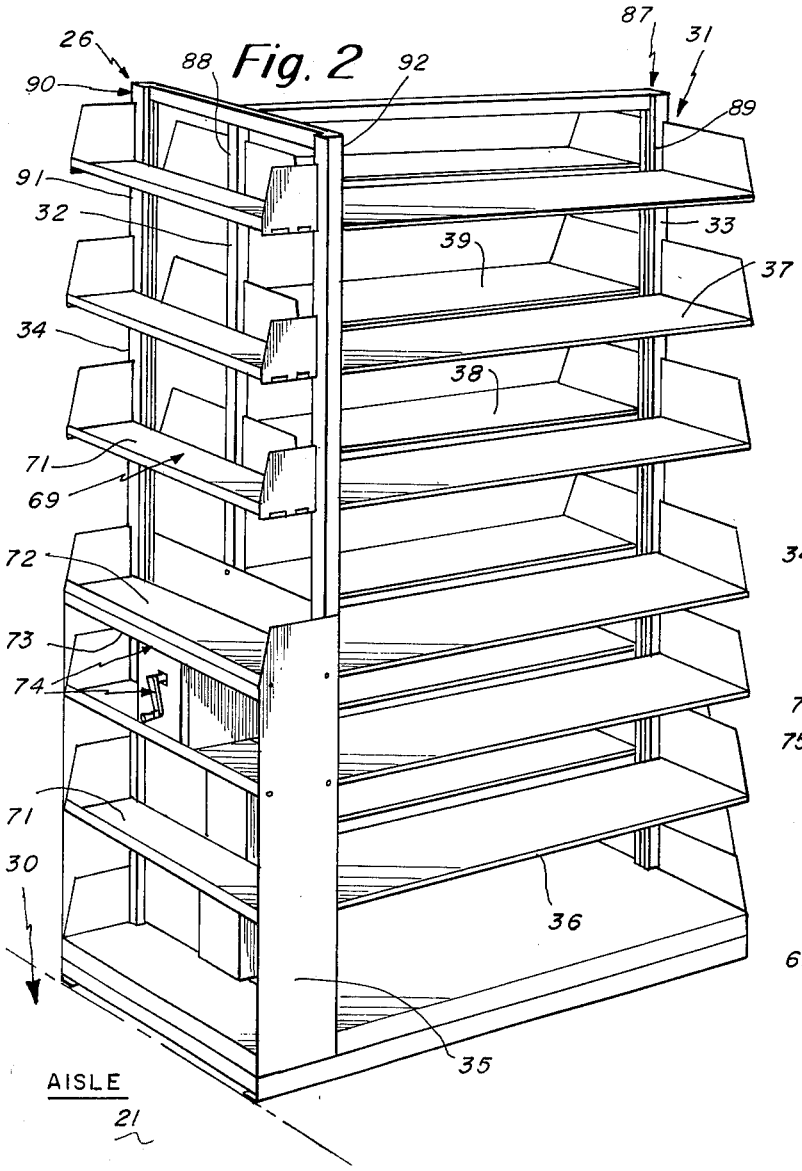
FIG. 2 is a perspective view of a mobile compact shelving unit of the invention, showing that the tracks do not project beyond the stack.
Figure 3:
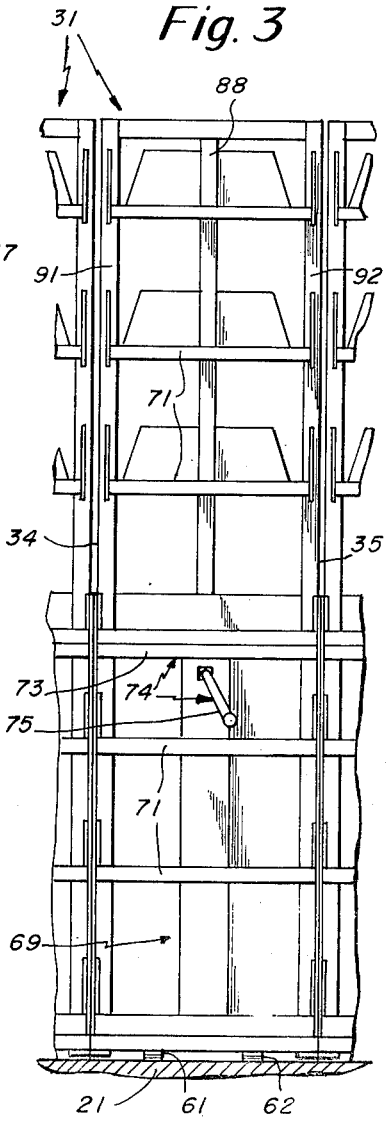
FIG. 3 is a fragmentary front elevation of a cluster of compact shelving stacks of the invention.
Figure 8:
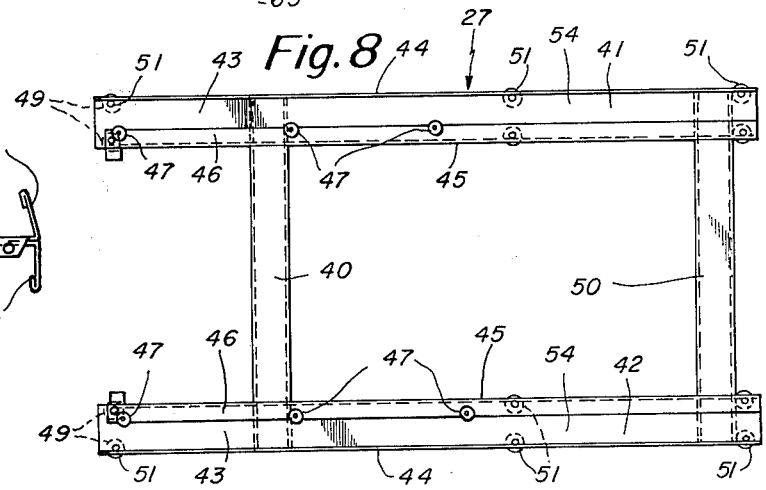
FIG. 8 is a top plan view of the set of parallel tracks for the carriage.
Figure 6:
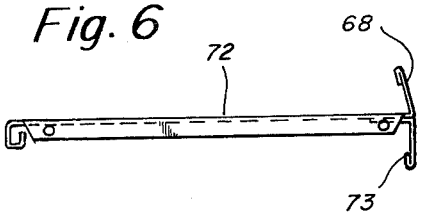
FIG. 6 is a side elevation, similar to FIG. 5, of a front shelf showing the downturned flange handle.

The compact shelving 20 of the invention includes a plurality of pairs 27 of spaced-apart, elongated, parallel, guide tracks 41 and 42, each pair extending longitudinally under one of the stacks 31 from its rear end 33 to its front end 32 and parallel to the sides 34 and 35 of the stack. It should be noted that the tracks 41 and 42 are so spaced and elongated as to be coextensive in these dimensions with the corresponding length and width of the stacks 31. Therefore they are normally completely hidden within the confines of the stack and present no dangerous obstacle to a user. As shown in FIGS. 8 and 9 each track 41 or 42 is formed of a channel iron 43, of U-shaped configuration, the outer, upstanding, leg, or flange, 44 being of considerable height and the inner leg, or flange, 45 being outturned to form a horizontal support 46 upon which a plurality of spaced rollers 47 are rotatable to guide the carriage 48. The rollers 47 are steel tired bearings of a type commercially available.

Each track 41 or 42 includes a plurality of pairs 49, of leveling screws 51, spaced therealong to permit the tracks to be levelled on floor 21 without requiring embedment in, or damage to the floor.

Cross braces 40 and 50 are welded to tracks 41 and 42 to form an integral unit, the braces 40 and 50 also being steel channels which are of inverted U-shaped configuration.

Preferably each stack 31 is upstanding from an elongated rectangular carriage 48 (FIG. 7) and affixed thereon by welding, bolts or other convenient means. Each carriage includes a pair of rollers 52 and 53 each on an opposite side of the rear of the bottom of the stack, and mounted to rotate in a vertical plane on a horizontal axis in one of the track 41 or 42, along the central web, or bight, 54 of the channel 43 thereof. Each carriage 48 comprises a pair of parallel side frame pieces 55 and 56, a rear frame piece 57, a front frame piece 58, and an intermediate cross frame piece 59, all welded into an integral unit.

Figure 4:
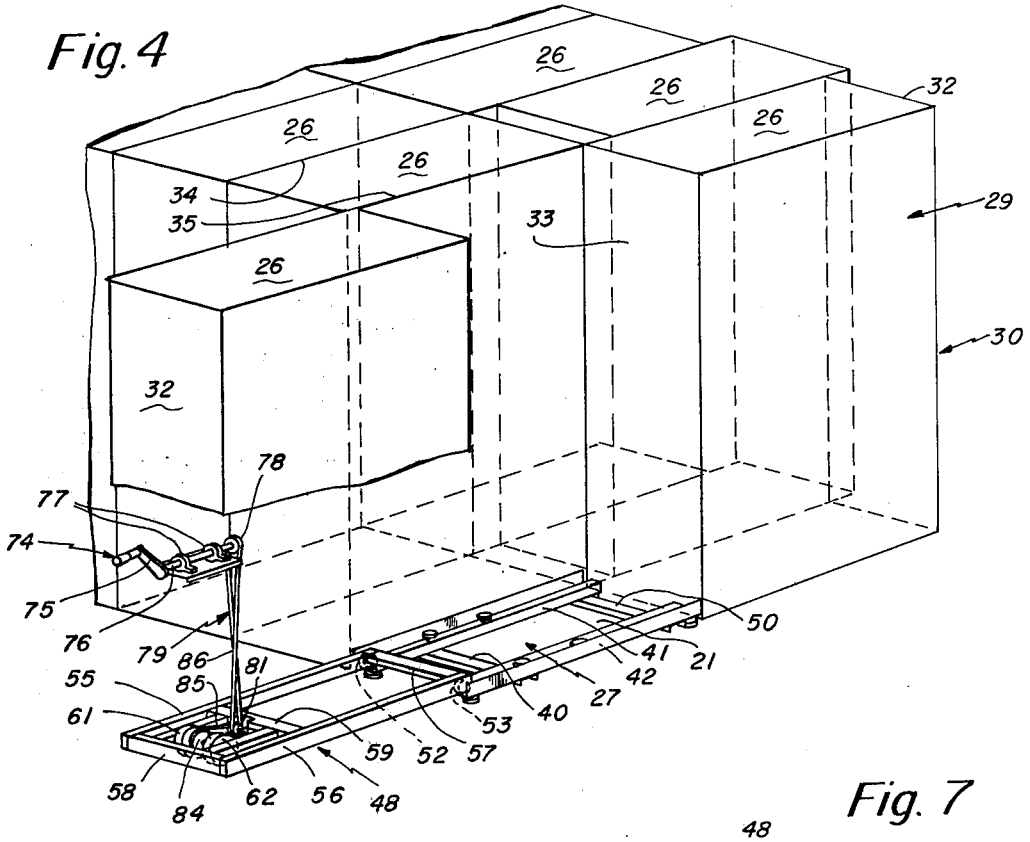
FIG. 4 is a diagrammatic perspective view illustrating a cluster of stacks of the invention and the power transmission for moving each stack.
Figure 7:
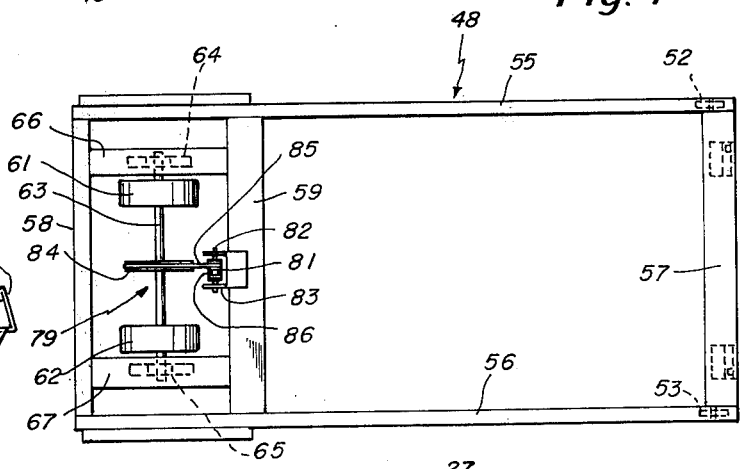
FIG. 7 is a top plan view of the carriage of the invention.

Each carriage 48 also includes a pair of plastic tired wheels 61 and 62 fast on an axle, or shaft, 63, rotatable in spaced apart bearing blocks 64 and 65, the blocks being supported on longitudinal frame pieces 66 and 67. The wheels 61 and 62 are rollable on the floor 21 to support the front of the stack as it moves endwise out of the cluster with its rearward portion guided in, and supported on, the parallel tracks 41 and 42. The wheels 61 and 62 are each on an opposite side of the front of the bottom of the stack and are housed between the tracks 41 and 42 in fully retracted position (FIG. 4).

Figure 5:
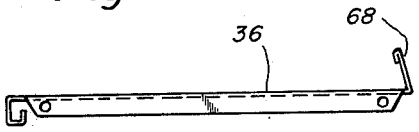
FIG. 5 is an enlarged end elevation of a side shelf, showing the integral upturned flange for retaining books.

As shown in FIG. 5 preferably each side shelf such as 36, 37, 38 or 39 is formed of sheet metal with an integral, upturned flange 68 extending along the outer side edge to prevent dislodgment of books during motion of the mobile stacks 31.

Each stack 31 preferably includes a front stack 69 of shelves 71, which shelves are open and exposed even when the stacks are closely packed and juxtaposed in a cluster 26 or 29. Thus about twenty percent of the shelving of each unit 26 of the compact shelving 20 is normally exposed and readily accessible from an aisle 21.

A waist-high, front shelf, such as at 72, is provided with a downturned flange 73 (FIG. 6) to serve as a finger grip handle means 74 whereby a user may pull a stack 31 endwise out of a cluster to roll out into the aisle 21 to expose the open side shelves, and push the stack back into the cluster on its wheels 61, 62 and on its track rollers 52 and 53.

The handle means 74 preferably however, comprises a removable crank handle 75, attachable on a longitudinally extending shaft 76 rotatable in brackets 77 at the front end 32 of the stack to rotate a pulley 78, the crank member 75 and pulley 78 being rotatable in a plane parallel to the plane of the front end 32. Power transmission means 79, includes a pulley 81, rotatable on a shaft 82 in a bracket 83, a pulley 84 fast on the axle 63 of the wheels 61 and 62 and a belt 85 trained around pulley 84 and 81. Pulley 81 is a double pulley so that a twist belt 86 is trained around the dual portion and around the pulley 78 to drive the wheels by means of an exerted force of less than ten pounds per square inch in the direction of advance or retraction.

Each unit, or module, 26 forming a mobile stack 31 is formed by an upstanding, rectangular, welded frame 87, extending in a longitudinal plane and having slotted uprights 88 or 89 to removably receive the hooks, of the opposite, horizontal, removable, sheet metal, shelves 36, 37, 38 and 39. The front stack 69 is also formed by a similar rectangular upstanding frame 90 having slotted uprights 91 and 92 for the front shelves 72, frame 90 extending in a lateral plane normal to frame 87.

I claim:

1. Compact shelving of the type having a cluster of identical, elongated upstanding stacks of shelves, normally juxtaposed to each other side-by-side, said stacks being movable horizontally relative to a floor for separation from each other to gain access to the shelves on each opposite side of an individual said stack, said compact shelving characterized by:

each said stack being formed of a plurality of open shelves supported on each opposite side of a central, upstanding rectangular frame;

a plurality of pairs of elongated parallel, guide tracks set apart a predetermined space, each extending longitudinally under one of said stacks from back to front, each coextensive in length with a said stack; and each stationary relative to said floor and stack;

a plurality of elongated, rectangular, carriages, each affixed under and supporting, one of said stacks, and coextensive in length therewith;

a plurality of pairs of rollers, each on an opposite side of the rear of the bottom of said carriage and mounted for rotation on the pair of guide tracks under said stack, a plurality of pairs of wheels, each on an opposite side of the front of the bottom of each said carriage normally mounted in said space between said tracks for rotation on said floor, any of said juxtaposed stacks being movable longitudinally as an integral unit in an endwise direction from back to front and return on said wheels and on said rollers on said tracks, out of said cluster to expose the shelves on each opposite side thereof, and mechanical advantage handle means on the front end of each said stack for enabling manual endwise movement thereof.

2. Compact shelving as specified in claim 1 plus a plurality of open shelves in a vertical array on the front of each said shelf stack supported in an upstanding rectangular frame extending laterally thereof whereby approximately twenty percent of the shelves of each stack are exposed when said stacks are clustered in close juxtaposition.

3. Compact shelving as specified in claim 1 wherein:

said mechanical advantage handle means on the front of each stack comprises a member, of large diameter, rotatable in a plane parallel to the front end of a stack and power transmission means actuated thereby for rotating the pair of wheels under the front of the stack in a plane normal to the plane of rotation of said member.

4. Compact shelving as specified in claim 3 wherein:

said power transmission means includes an axle, upon which each pair of said wheels are fast, a first pulley fast on the center of said axle, a second pulley of reduced diameter, and a drive belt twisted through an angle of ninety degrees and trained around said second pulley and a third pulley rotated by said member.

5. Compact shelving as specified in claim 1 wherein:

said mechanical advantage handle means includes a crank rotatable in a plane parallel to the front end of each said stack and pulley and twist belt power transmission means for operably connecting said crank to the pair of wheels under the front of said stack whereby turning said crank provides mechanical advantage for moving said stack endwise in and out of said cluster with exertion of less than 15 pounds per square inch.

6. A compact shelving unit comprising:

a pair of spaced, elongated parallel guide tracks of predetermined length and width stationarily supported on the floor of a building, an elongated upstanding stack of open shelves affixed on a central longitudinally extending, upstanding rectangular frame, said stack being coextensive in width and length with said tracks an elongated rectangular carriage affixed under and supporting each said stack and coextensive in length therewith said carriage having rollers at the bottom rear guided in said tracks and having a pair of plastic tire wheels at the bottom front thereof normally located between said tracks and supported on said floor, said stack being movable endwise relative to said tracks, to expose the opposite shelves along the longitudially extending sides thereof, when said stack is one of a cluster of said side-by-side juxtaposed said stacks.

7. A compact shelving unit as specified in claim 6 plus:

a plurality of open shelves on the front end of said stack supported in an upstanding, rectangular frame extending laterally thereof for permanently exposing about 20 percent of shelf space when said stack is one of a cluster of side-by-side juxtaposed said stacks.

8. A compact shelving unit as specified in claim 6 plus:

mechanical advantage handle means actuatable from the fron end of said stack, and operably connected to the plastic tired wheels under said stack, for advancing and retracting said stack in an endwise direction along said tracks to expose the said opposite, open side shelves thereof.

9. Compact shelving comprising a plurality of identical upstanding elongated stacks of open shelves, normally juxtaposed to each other side-by-side; each stack having a central, longitudinally extending, upstanding, rectangular frame supporting a set of opposite side shelves and having a front, laterally extending upstanding frame supporting a set of front shelves, all integral with each other and movable as a unit;

a plurality of pairs of guide tracks, each pair extending longitudinally under one of said stacks and stationarily supported on the floor;

a plurality of elongated, rectangular carriages, each affixed under and supporting one of said stacks, each carriage having a pair of rear rollers guided in said tracks and having a pair of front wheels guided on said floor and rotatable in longitudinal planes for moving said carriage and stack, and mechanical advantage handle means on the front of said stack including a handle of large diameter rotatable in a lateral plane at the front of said stack and power transmission means including a belt twisted through an angle of 90° connecting said handle to said front wheels.

* * * * *